United States Patent [19]

Woyden

[11] 3,964,990

[45] June 22, 1976

[54] PRECIOUS METAL RECOVERY SYSTEM

[76] Inventor: Stanley Woyden, 1575 High Ridge Road, Stamford, Conn. 06903

[22] Filed: Nov. 4, 1974

[21] Appl. No.: 520,246

[52] U.S. Cl. ..... 204/275; 204/228; 204/109

[51] Int. Cl.[2] ..... C25C 7/00

[58] Field of Search ..... 204/109, 275, 228 X, 204/228

[56] References Cited

UNITED STATES PATENTS

| | | | |
|---|---|---|---|
| 300,950 | 6/1884 | Cassel | 204/109 |
| 1,219,333 | 3/1917 | Kynaston | 204/275 |
| 3,458,425 | 8/1969 | Tolle et al. | 204/109 |
| 3,558,466 | 1/1971 | LeBrizzi et al. | 204/263 |
| 3,715,291 | 2/1973 | Bentley | 204/109 |
| 3,728,245 | 4/1973 | Preis et al. | 204/149 |

*Primary Examiner*—R. L. Andrews
*Attorney, Agent, or Firm*—Amster & Rothstein

[57] ABSTRACT

This application discloses a system for recovering silver and other precious metals from waste solutions such as those used in the development of photographic film. The system includes a holding tank from which solution is pumped into a recovery tank intermittently in dependence upon the concentration of metal in solution in the recovery tank. The system operates with a substantially constant voltage across the plates in the recovery tank, with the concentration of solution in the recovery tank being maintained substantially constant by the intermittent operation of the pump. The plating tank incorporates rotating plating surfaces in combination with a circulating system which maintains a flow of solution within the recovery tank to foster rapid and uniform plating of metal.

4 Claims, 5 Drawing Figures

PRECIOUS METAL RECOVERY SYSTEM

This invention relates to an apparatus and method for recovering silver or other precious metals from solutions by electroplating.

It is well known that silver can be recovered from waste photographic solutions and that other precious metals can be recovered from solutions of other types by inserting electrodes in the solution and applying a selected voltage across the electrodes such that the silver or other precious metal is plated onto the negative electrode (the cathode). In silver recovery systems used in conjunction with photographic solutions, the cathode is usually stainless steel and the anode (the positive electrode) is also stainless steel. In other systems the electrodes may be of different materials.

It is desirable that silver recovery systems of this type be located at the site of generation of the waste solutions and that they be automatically controlled to recover silver and dispose of the remaining waste solution into an appropriate drain. There are a number of factors in the control of the plating reaction which create difficulties in installations of this type. Specifically, the power applied across the electrodes within the solution must be related to the concentration of silver in the solution. If too much power is applied to the plates with respect to the quantity of silver available in the solution, a chemical reaction occurs within the solution which produces a sulfide gas (the process is hereinafter referred to as "sulfiding"). The generation of sulfide gas creates a very strong odor in the environment and, if permitted to continue, will cause the silver to burn and flake, permitting flakes of sulfided silver to wash away with the waste solution. If the voltage applied to the recovery system is too small with respect to the quantity of silver in the solution, then the silver may not be recovered in the time permitted for recovery and will similarly be discharged with the system effluent and lost.

Prior art systems have attempted to solve this problem by manually regulating the voltage applied to the plates in dependence on the silver concentration of the system. However, these systems are cumbersome and have not been found adequate for automatic operation of high volume systems.

In another approach, attempts have been made to maintain a substantially constant flow of liquid through the holding tank, with the electrodes being activated only during the time that additional liquid is being introduced. In systems of this type, the voltage applied to the plates is maintained constant at a level appropriate for the approximate expected average silver concentration of the input fluid and the concentration in the tank is thus as constant as the imput solution. However, systems of this type are useless when the concentration of solution varies in any substantial way. When high concentration solution is introduced into a system of this type, substantial quantities of silver pass through the system without being recovered. When low silver concentration solution is introduced, sulfiding occurs.

In addition, prior art systems have generally used a variety of plate configurations intended to permit relatively rapid and uniform plating of silver from solution. In some cases, these configurations have included a central negative electrode comprising a series of metal discs mounted on a central shaft with the shaft being adapted to rotate. In prior art systems, the plates have been angled and other steps have been taken to attempt to create some turbulence in the solution. However, this type of turbulence is not conducive to rapid uniform plating, and these systems, while better than the previous systems, still recover relatively low volumes of silver per unit time for use in high volume equipment.

It is thus a principal object of the present invention to provide an apparatus and method for recovering silver or other valuable metals from solution which maintains appropriate plating conditions substantially automatically.

A further object of the present invention is to provide a system which will accept a broad variety of silver concentration solutions and recover substantially all silver from said solutions, irrespective of initial concentration without sulfiding or discharging excessive silver in the effluent.

A further and related object of the present invention is to provide a silver recovery system including an electrode and liquid circulation arrangement which provides a rapid and uniform plating of silver in a form most desirable for stripping and use.

In accomplishing these and other objects in accordance with the present invention, applicant's system employes a holding tank and a metal recovery tank, with solution being pumped from the holding tank to the recovery tank intermittently when the concentration of metal in the recovery tank falls below a predetermined value. Concentration of metal in the recovery tank is measured by carefully measuring minute changes in the regulated voltage across the electrodes. Further, applicant's system incorporates a series of alternating anode and cathode plates on a rotating central shaft in combination with a circulating system in the recovery tank to foster rapid plating of metal.

Further objects, features and advantages of the present invention will be appreciated by reference to the following detailed description of a presently preferred, but nonetheless exemplary, embodiment thereof, when taken in combination with the appended drawings wherein.

Figure 1:
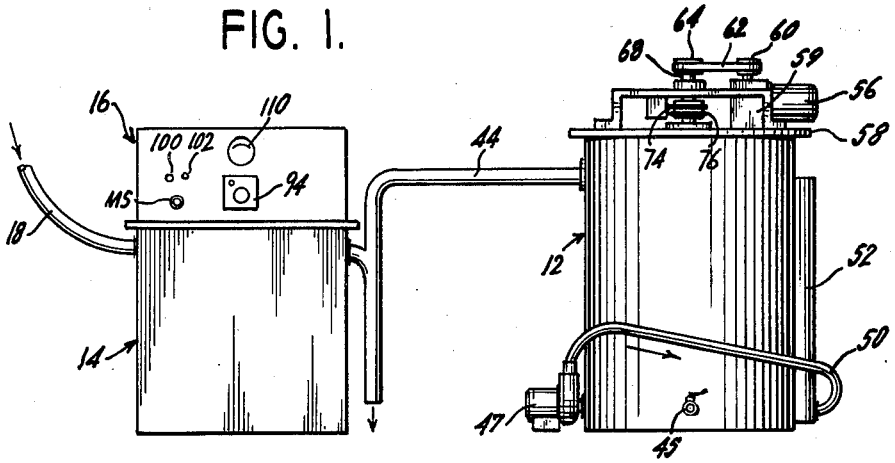
FIG. 1 is an exterior elevation of applicant's silver recovery system.

As shown in FIG. 1, applicant's system includes a silver recovery tank 12, holding tank 14 and an electronic control console 16. It is to be understood that the preferred embodiment of the present invention will be described herein in terms of a silver recovery system particularly adapted for removing silver from photographic solutions. However, it should be understood that applicant's invention may be adapted to use in the removal of other metals from solution as well.

Figure 2:
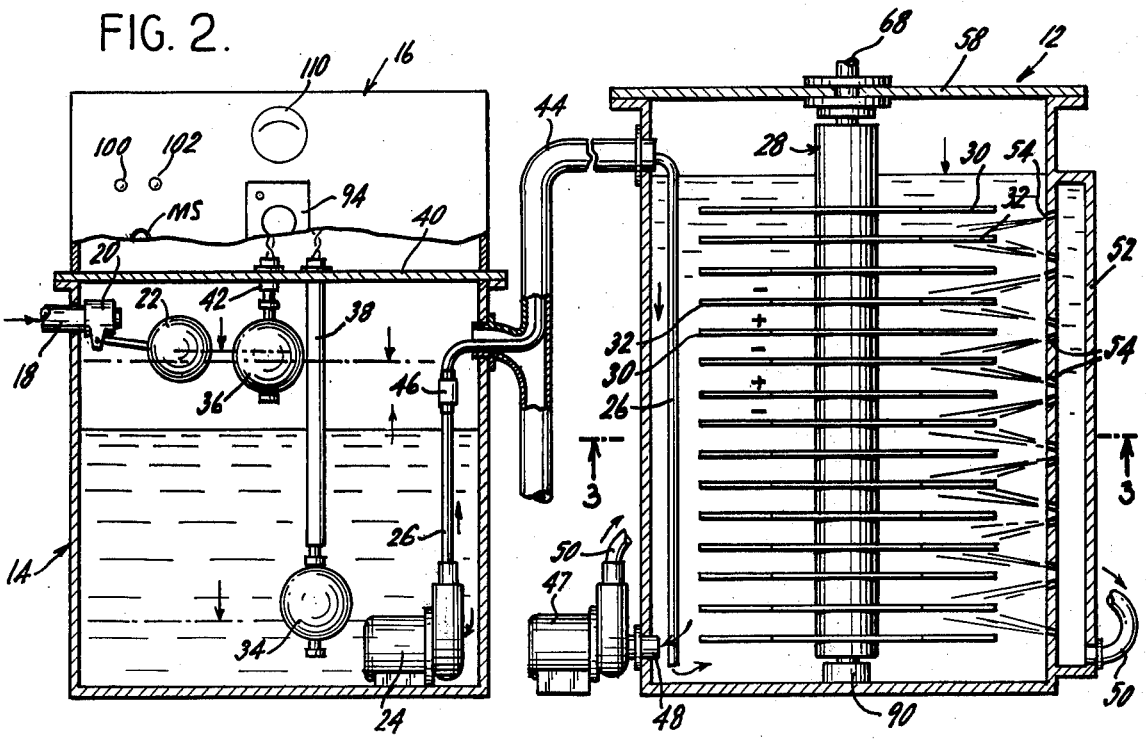
FIG. 2 is a cross-sectional view, partially broken away, of applicant's silver recovery system.

Fluid is introduced into holding tank 14 through an inlet tube 18 which may be supplied directly from photographic processing equipment or from a further holding tank or reservoir of solution. As shown in FIG. 2, the input end of tube 18 includes a float valve system including a valve section 20 and a float member 22. This arrangement is adapted so that if for some reason the liquid level in holding tank 14 should rise too high, the input tube 18 would be automatically shut down. This feature may or may not be adopted depending upon the nature of the input feed to the system. Without this shutoff device, if the liquid level rises too high, it will automatically spill down the drain system to be described hereinafter and some silver content will be lost. However, in view of the operation of applicant's system, this is unlikely.

In overall operation, the holding tank 14 includes a submerged pump 24 which communicates via tube 26 into the recovery tank 12. The recovery tank includes a central stem 28 carrying alternate anode 30 and cathode 32, electrode elements in the form of octagonal plates mounted on shaft 28. The specific configuration operation of these electrodes will be described in greater detail later. For the present, it suffices to say that a substantially constant voltage is applied across the cathode and anode elements with the voltage providing adequate plating at a desired silver concentration. The actual concentration of silver in the solution in plating tank 12 at any given time is detected by noting minute variations in the substantially constant voltage applied to the plates. When the concentration of silver in solution in tank 12 decreases the voltage across the anode and cathode 30, 32 increases very slightly. This slight increase in voltage is sensed by electronic circuitry to be described hereinafter and, when sensed, initiates operation of submerged pump 24 in holding tank 14. Pump 24 introduces additional silver-carrying solution into tank 12. Since no silver has been removed from the solution in the holding tank, introduction of this solution tends to raise the level of silver concentration in the tank 12. When the silver concentration in the solution in tank 12 reaches a desired level, this level is sensed by the reverse minute change in the voltage across the plates and the pump operation is discontinued. As silver continues to be recovered from the solution in tank 12, the silver concentration again falls (as measured by minute variations in the voltage), and pump 24 is again activated, raising the silver concentration.

This process continues during recovery operations such that the voltage across the plates is maintained substantially constant and the silver concentration is maintained substantially constant within sufficiently tight tolerances to preclude either sulfiding or significant silver loss.

As will be seen in FIG. 2, the holding tank includes a lower float valve 34 and an upper float valve 36. These float valves are preferably of a magnetic actuated type since the solution in which they are immersed is particularly caustic and therefore destructive of metal parts which are not completely sealed. Valves of this type are commercially available and applicant has found the valve made by The Huston Company of Cheshire Connecticut under Product No. HLS-100 and HLS-200 or LS-500-32 to be acceptable.

The lower float valve 34 is maintained in desired position by a stem 38 suspended from a top closure member 40 which overlays holding tank 14. Closure 40 is preferably substantially sealed to prevent the escape of noxious fumes from holding tank 14 into the electrical control box 16 or into the environment. Upper float valve 36 is supported by a short stem 42. The float valves are connected into the control system as will be seen in greater detail in the discussion of FIG. 5 in such a way that if the water level falls below float valve 34, the float valve contacts will be opened and the entire system, including the pumps and electroplating voltage, will be disengaged. This is required because when there is insufficient fluid in tank 14 to replenish the supply of silver in solution in tank 12, the silver concentration cannot be maintained. If under these circumstances the power applied across the electrodes in tank 12 were continued, sulfiding would occur.

The upper float valve is positioned to automatically start the recovery system when the fluid level builds up. This automatic start is in addition to a manual start described later. The height of valve 36 can be selected such that the system will turn off and on as frequently as desired. Valve 36 could be located just above the level of pump 24, in which case even a relatively slight amount of liquid in holding tank 14 would automatically activate the system. However, repeated turning on and off of the overall system may not be desirable, so that float switch 36 is preferably located in approximately the position shown.

The silver recovery tank itself includes an output drain tube 44 adjacent the uppermost level of liquid desired in the recovery tank. As additional solution is pumped into the system through tube 26, an equivalent amount of liquid is displaced and discharged out drain 44. A drain valve 45 is also provided.

Tube 26 includes a check valve 46 which permits liquid to flow in tube 26 in one direction only, i.e., from the holding tank 14 to the recovery tank 12. This valve is designed to prevent a siphoning effect which might otherwise occur since the liquid level in tank 12 is higher than the liquid level in tank 14.

Figure 3:
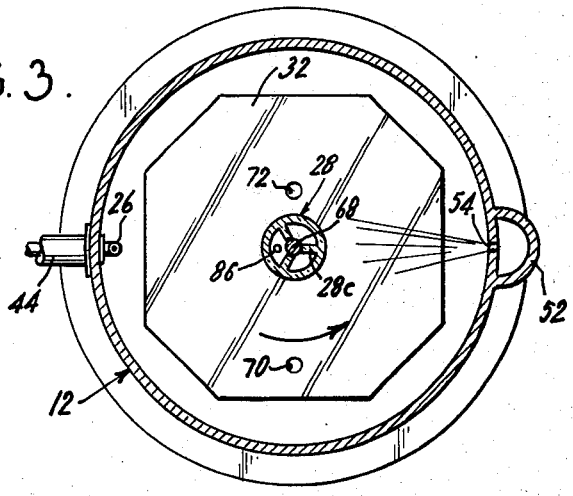
FIG. 3 is a cross-sectional view taken along line 3—3 in FIG. 2 looking in the direction of the arrows.

Obviously, it is important to maintain a very thorough mixing of solution in tank 12 such that additional carrying high silver concentration from tank 14 is quickly dispersed throughout the recovery tank. This is accomplished by a circulating pump 47 which withdraws fluid from the recovery tank 12 through circulating input port 48 and circulates that fluid through tube 50 (shown complete in FIG. 1 but broken away in FIG. 2) which feeds a manifold 52 mounted along the edge of recovery tank 12. Pump 47 is in operation for so long as plating power is applied to the electrodes. Manifold 52 includes a plurality of output ports 54 which are preferably angled with respect to the horizontal face of plates 30, 32 such that a stream of circulating fluid is directed onto the upper and lower surface of each anode 32. As will be seen in FIG. 3, this may simply be accomplished by forming the manifold 52 as an addition to the tank 12 and boring holes 54 in tank 12 in different angled directions so as to align with the cathodes 32.

Note that the output of tube 26 carrying new fluid from holding tank 14 is directly adjacent the input port 48 of circulating pump 47 such that additional silver concentration which is deposited in the plating tank is almost immediately circulated throughout the tank.

Plates 32 preferably occupy a substantial portion of the cross section of tank 12. In addition, applicant has found it desirable not to use round plates in a system of this type, since when a round plate is used, silver tends to build up on the outer edge of the plate, interfering with the circulation of liquid around the plate and applying substantial forces to the interior plate-supporting structure. In addition, the present shape of plates (as opposed to a circular shape) makes it easier to strip the silver from the plates, since it provides a solid grasping surface on the plate during the stripping operation.

In the present preferred, applicant has used preferred embodiment, plates, seven of which are cathode or negative silver plating plates, and eight of which are anodes or positive plates. Also, in the preferred embodiment, tank 12 is of approximately a six and one-half gallon capacity and jets 54 are of approximately 1/16 inch diameter.

Plates 30, 32 and stem 28 are constantly rotated for so long as the system is in operation by action of motor 56 which is suspended above a plating tank top closure 58. As in the case of closure 40, closure 58 is preferably substantially sealed so as to prevent the introduction of noxious and caustic fumes into the environment. Motor 56 operates through a gear box 59 which turns pulley 60. Pulley 60 is secured by flexible belt 62 to a pulley 64 which is unitary with the center shaft 68 of shaft member 28 so as to rotate the entire shaft plate assembly. Applicant has found that rotation at approximately 150 revolutions per minute is desirable for plating operations. However, a variety of different speeds can be accomplished by selection of motor 56 and gear drive 59.

Plates 30, 32 preferably include a pair of holes 70, 72, each of which is approximately one-half inch in diameter with one hole being located relatively close to the plate center and the second hold being located on the side of a plate opposite to the first hole and closer to the plate periphery. These holes are to prevent the entrapment of air under the plates 30, 32 and their size is selected such that, even with an accumulation of silver on the plates, the hole will not be completely closed. Thus any air which may be introduced into the tank by pump 24 will move up through holes 70, 72 to the upper surface of liquid in tank 12 and escape through the drain or elsewhere.

Electrical contact to the electrodes 30, 32 is accomplished through a pair of brushes 74 which engage a pair of slip-rings 76 mounted on shaft 68.

Figure 4:
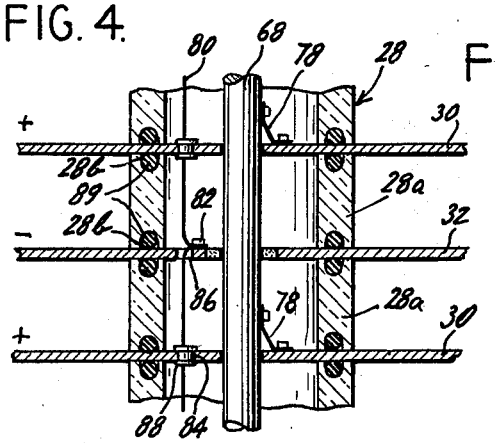
FIG. 4 is an enlarged view of the central shaft of applicant's silver recovery tank, showing the interconnection of the electrodes.

The interior construction of shaft 28 including shaft 68 is shown in FIG. 4. The positive brush engages the positive slip ring which is in electrical contact with center post 68 itself. As seen in FIG. 4, post 68 is tied by a series of conductors 78 to the anode or positive plates 30.

The negative brush 74 is in contact with a negative slip ring 76 which is in turn in contact with conductor 80 which runs parallel to rod 68 inside post 28. Conductor 80 is in contact with tie point 82 on each negative plate 32 and passes through apertures 84 in the positive plates 30 and apertures 86 in the negative plate 32. As will be seen in FIG. 4, the apertures in positive plates 30 include a rubber grommet 88 to prevent electrical contact between conductor 80 and the positive electrode plate 30.

Central stem 28 includes a series of cylindrical stem sections **28*a*, each positioned intermediate adjacent plates 30, 32. Each stem section 28*a* includes an annular groove 28*b* at its upper and lower ends, in which is contained an O-ring 89. The O-rings provide a secure and tight engagement between elements 28*a* and the anode and cathode plates 30, 32. To maintain the elements 28*a* in a stable radial position with respect to center shaft 68, each element 28*a* includes a series of radial spokes 28*c* which extend inwardly up to and engaging post 68. These radial spokes preferably run the entire height of each element 28*a*. These spokes can be seen in FIG. 3, although because of the position of the figure, they do not appear in FIG. 4. In effect, one such spoke is positioned behind rod 68 and therefore not visible in FIG. 4.**

The entire core structure including rod 68 and plates 30, 32 are supported in a socket 90 at the bottom center of tank 12. It will be appreciated that, with appropriate supports, socket 90 can be removed and the entire assembly simply suspended in the tank without need for lower guide 90.

It will also be appreciated that the core 28 carrying electrodes 30, 32 may be constructed in a variety of manners without departing from the spirit or scope of the present invention.

Also as shown, the feed tube 26 is interior of the drain tube 44. In the preferred embodiment, the feed tube has a diameter of approximately ⅛ inch and the drain tube has a diameter of approximately 1½ inch. This construction is provided so that only a single tube is apparent to the user interconnecting the two tanks for simplicity. It should be understood that separate tubes could also be used.

Applicant has found that it is desirable that the submerged pump 24 be a magnetically coupled pump having plastic impellers. A pump of this type is manufactured by Dayton Electric Manufacturing Co. under the name TEEL. Applicant has found a pump of this type desirable because if the pump is driven directly, silver tends to plate on the pump shaft and impellers, thereby fouling the pump. In a system of the size described herein as the preferred embodiment, a pump of approximately 25 gallons per hour capacity will be adequate.

Figure 5:
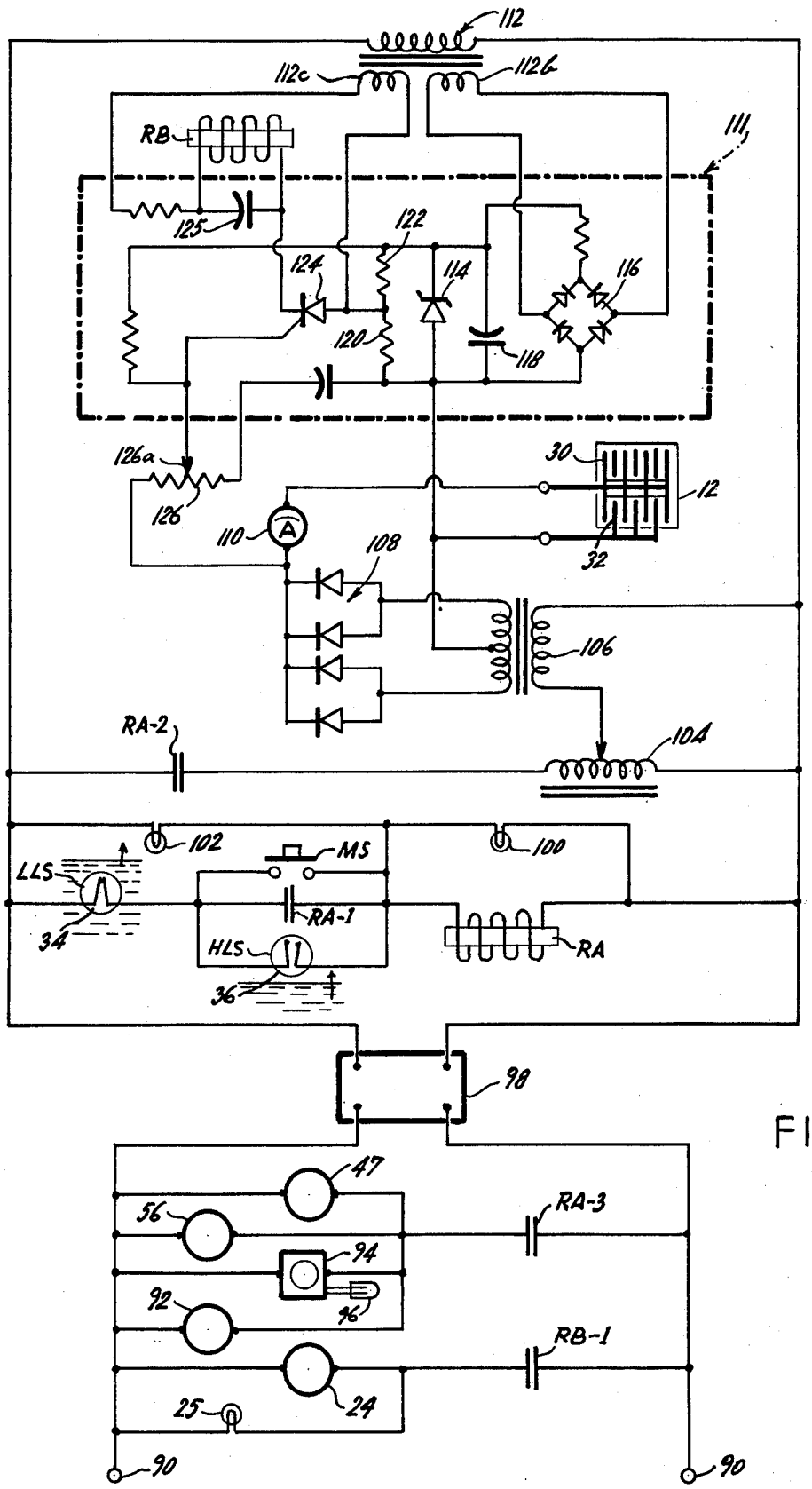
FIG. 5 is a schematic control diagram showing the control apparatus of applicant's silver recovery system.

The circuitry for providing the plating voltage and the control circuitry is shown in FIG. 5 wherein power is applied to the control system from an appropriate 115 volt AC line across terminals 90. This AC power is applied through relay contacts RB-1 across pump 24 and a lamp 25, if desired.

The same 115 volt AC power is similarly applied through relay contacts RA-3 to circulating pump 47, shaft rotating motor 56 and a cooling fan 92 (not shown in the other figures) which maintain appropriate air circulation to the high current electronic power circuitry in circuit box 16. In addition, an hour meter 94 is provided which includes an indicator light 96. Hour meter 94 is operative for so long as relay contacts RA-3 are closed which, as will be seen hereinafter, is equal to the time during which plating operation is actually occurring. This meter thus provides an indication of what the actual plating time in the system has been and is adapted to light bulb 96 when a predetermined plating time has been reached. Since the voltage across the plating system is substantially constant and the silver concentration in the system is substantially constant, it can be expected that operation for an approximately known time will sufficiently plate the cathode to require stripping. Thus, meter 94, in conjunction with light 96, indicates when stripping of the system is appropriate.

The 115 volt AC input power is also applied across a voltage regulator 98, the output of which is a constant 118 volt supply. This supply may be appropriately fused (not shown) and functions to operate the relays, the power system, and the voltage sensing control system.

The regulated voltage is first applied across the coil of relay RA which is in series with the first set of contacts RA-1 of relay RA. In this configuration, relay RA is in effect a self-latching relay such that once current is applied to coil RA, the relay stays closed through its own latching contacts RA-1 until power to the coil is removed by some other means. Essentially, relay RA controls the overall functioning of the system, including the application of plating current to the plates, the application of current to motor 56, the operation of circulating motor 47 and the operation of the timing device 94 and fan 92. All these operations are activated by the closing of relay contacts RA-3 previously referred to.

Relay RA can be activated only when the low level sensing float switch 34 (LLS) is closed, since this switch is in series with the coil of relay RA. So long as the low level sense switch is closed, the operation of the apparatus will be initiated either by depression of the manual set button (MS) also shown on panel 16 in FIG. 1, or by the closing of the high level float switch 36. A small neon indicator light 100 is provided across the coil of relay RA to provide an indication that relay RA is activated and that the plating system is in operation. Lamp 100 appears on the front panel of electrical cabinet 16 as shown in FIG. 1.

A second neon lamp 102 is provided to show standby operation. This lamp is lighted when the system is ready for operation but is not in fact operating. When either MS, RA-1 or HLS is closed (and LLS is closed) bulb 102 is shorted and goes out.

Whenever relay RA is on, so that contacts RA-1 and RA-3 are closed, contacts RA-2 are also closed. The closing of these contacts places the regulated AC supply across the variable inductance 104 which applies power across the primary winding of power transformer 106. Since the current across plating plates 30, 32 in tank 12 shown schematically in FIG. 5 requires direct current for plating, and since the current is quite high in the order of 20 amps, high power rectifiers in the form of four power diodes 108 are employed. The output of rectifier 108 is applied through an ammeter 110 to the positive center stem of the anode in the recovery system as shown schematically in FIG. 5. The ammeter need not remain in the operating circuit, but may be used during installation for initial adjustment of the system. The negative plates are connected to the center tap on the secondary winding of power transformer 106 in conventional fashion to provide regulated supply to the plates.

The circuitry shown in the area 111 enclosed by broken lines is essentially a preferred embodiment of the voltage sensing control circuit for pump 24. It is the object of this circuitry to sense any voltage change across the plates (which is due to reduction in the silver concentration within the plating solution) and to turn on pump 24 when the voltage change indicates a sufficient drop in silver concentration. It is the function of this circuitry to activate the coil of relay RB, closing contacts RB-1 and activating pump 24 when the voltage increases across the plates (thereby indicating a decrease in silver concentration).

Power is applied to the control circuit through transformer 112 with the primary winding of the transformer receiving regulated 118 volt AC current and producing a low voltage output of approximately 6.3 volts on the first secondary coil 112*b* and a high voltage of approximately 125 volts on the second secondary coil 112*c*. The 6.3 volt output of coil 112*b* is applied across a rectifier comprising four diodes 116 in a conventional bridge circuit. The output of rectifier 116 is maintained at a fixed voltage by zener diode 114 with a capacitor 118 being connected in parallel with the zenor diode 114 to filter out any remaining AC ripple. Thus, a fixed constant DC voltage is maintained across the zenor diode 114.

At the same time, the 125 volt output of secondary coil 112*c* is impressed across the coil of relay RB through a silicon-controlled rectifier (hereinafter "SCR") 124. When SCR 124 fires, power is applied across coil RB and capacitor, thus closing relay contacts RB-1 and applying AC power to pump 24. When the SCR 124 shuts down, power is removed from coil RB and contacts RB-1 are opened, stopping pump 24. Capacitor 125 is used to remove AC effects from the coil RB.

The control voltage for SCR 124 is provided as follows. The center tap of potentiometer 126 is applied to the control voltage point of SCR 124. When the system is plating properly and the silver content in solution is at the proper level, the potentiometer 126 is set so that the voltage at the center tap 126*a* is zero. In this state, the SCR 124 is non-conductive. As the silver is plated out of solution, the voltage across the plates, and hence the voltage across 126, increases. When this voltage increases to the control voltage of the SCR, the SCR fires, applying power to relay coil RB and activating pump 24. The pump continues to operate until the concentration of silver in the plating solution is increased sufficiently to reduce the voltage across the plates and hence the voltage at the center top of potentiometer 126 back to at least its normal voltage. When this voltage decreases sufficiently, the SCR shuts off, thereby removing power from the coil of relay RB and shutting off the pump. The resistive voltage divider 120, 122 provides proper DC bias to the SCR 124.

In practice, of course, there will be some slight delay in the increase of silver concentration in the system so that the voltage will not remain exactly constant. However, in view of the very stringent control provided by the SCR system, the voltage in the plating system is essentially constant for all practical purposes in terms of plating voltages.

It will be appreciated that the above system is capable of automatically controlling the plating conditions in spite of a substantial variability in the silver concentration of the input solution. If the input solution has a high concentration of silver, the pump 24 will operate for only a short period of time until appropriate concentration is developed in the plating tank. If the holding tank contains a low concentration of silver, the pump will continue to operate for a greater time before a proper concentration of silver is established in the plating tank. Throughout, the plating voltage and current are substantially constant and the silver concentration is substantially constant, such that for all the time that the system is plating, proper plating conditions are established.

Periodically, cover 58 is removed and the entire electrode assembly is removed and stripped. Applicant has found that the effluent of this system contains a very minimal silver loss. At the same time, with applicant's novel rotating plate manifold circulation system, applicant's system is able to plate substantial quantities of silver. Applicant's system is capable of unattended operation until stripping of the blades is required as indicated by clock 94 and lamp 96.

It will be appreciated that the above-described arrangements are merely examples of the application of the principles of the present invention. Additional embodiments will be apparent to those skilled in the art without departing from the spirit or scope of applicant's invention as defined in the following claims.

I claim:

1. A system for recovering metals from solution comprising a recovery tank having electrodes positioned therein, means for applying an electrolysis voltage to said electrodes, a holding tank for receiving liquid from a liquid source, means for feeding liquid from said holding tank to said recovery tank, means for sensing when the concentration of metal in said recovery tank deviates from a desired concentration, and control means responsive to said sensing means for activating said feeding means when the metal concentration in said recovery tank deviates from said desired concentration so as to transfer liquid from said holding tank to said recovery tank to automatically provide proper electrolyte concentration for plating.

2. Apparatus in accordance with claim 1 wherein said means for sensing the metal concentration in said recovery tank comprises means for sensing variations in the voltage across said electrodes.

3. Apparatus in accordance with claim 1 including means for sensing when said liquid level in said holding tank is below a predetermined level and control means responsive to said liquid level sensing means for disabling the system when said liquid level is below said predetermined level.

4. Apparatus in accordance with claim 3 further including second liquid level sensing means for sensing when said liquid in said holding tank is above a predetermined level and control means for activating said system when the liquid rises above said predetermined level.

* * * * *